US008837967B2

(12) United States Patent
Campbell et al.

(10) Patent No.: US 8,837,967 B2
(45) Date of Patent: Sep. 16, 2014

(54) DEVICE FOR DETERMINING AND ADJUSTING TRANSFER VOLTAGE IN AN IMAGING APPARATUS AND A METHOD THEREOF

(75) Inventors: Alan Stirling Campbell, Lexington, KY (US); Brandon Alden Kemp, Lexington, KY (US); Peter Brown Pickett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 532 days.

(21) Appl. No.: 12/842,834

(22) Filed: Jul. 23, 2010

(65) Prior Publication Data

US 2011/0280598 A1 Nov. 17, 2011

Related U.S. Application Data

(60) Provisional application No. 61/333,724, filed on May 11, 2010.

(51) Int. Cl.

| | |
|---|---|
| ***G03G 15/00*** | (2006.01) |
| ***G03G 15/16*** | (2006.01) |
| ***G03G 21/20*** | (2006.01) |
| ***G03G 15/20*** | (2006.01) |

(52) U.S. Cl.
CPC ..... *G03G 15/1675* (2013.01)
USPC ..... 399/66; 399/44; 399/45; 399/94; 399/97; 399/314

(58) Field of Classification Search
USPC ..... 399/44, 45, 66, 94, 97, 314
See application file for complete search history.

(56) References Cited

U.S. PATENT DOCUMENTS

| | | | | |
|---|---|---|---|---|
| 4,912,515 | A | 3/1990 | Amemiya | |
| 5,697,015 | A * | 12/1997 | Ream et al. | 399/66 |
| 2008/0145080 | A1 * | 6/2008 | Cook | 399/66 |

* cited by examiner

*Primary Examiner* — Jospeh S Wong
(74) *Attorney, Agent, or Firm* — William F. Esser

(57) ABSTRACT

A device and method for determining and applying a transfer voltage in an imaging apparatus is provided. A servo voltage is determined based in part upon a change in an environmental condition. A determination is made whether or not to perform a new transfer servo operation based upon at least one of an amount of time passing since the last transfer servo operation was performed and a comparison of the determined servo voltage and a servo voltage used in a prior transfer servo operation. A transfer servo operation includes charging a photoconductive drum to a charge corresponding to a printing voltage.

32 Claims, 5 Drawing Sheets

First Transfer Servo Algorithm

First Transfer Servo Algorithm

Second Transfer Servo Algorithm

DEVICE FOR DETERMINING AND ADJUSTING TRANSFER VOLTAGE IN AN IMAGING APPARATUS AND A METHOD THEREOF

CROSS REFERENCE TO RELATED APPLICATION

This claims the benefit of the earlier filing date of Application Ser. No. 61/333,724 filed May 11, 2010, entitled "Device for Determining and Adjusting Transfer Voltage in an Imaging Apparatus and a Method Thereof," the contents of which are incorporated by reference herein in its entirety.

BACKGROUND

1. Field of the Invention

The present invention relates generally to a device for transferring toner image from a photoconductive drum to a recording sheet in an imaging apparatus, and particularly to a device for determining and adjusting a transfer voltage in the imaging apparatus.

2. Description of the Related Art

In electro-photographic printing process, toner is transferred from a photoconductive drum to another media by bringing the media in contact with a toner image on the photoconductive drum. Then a voltage (also known as transfer voltage) is applied between the photoconductive drum and the media that causes toner that is charged to move from surface of the photoconductive drum to surface of the media. This transfer of the toner from the photoconductive drum to the media takes place either by a single transfer or a dual transfer. In a single transfer system, the media is most frequently paper. In a dual transfer system, the first transfer is from the photoconductive drum to an intermediate media, for example, an intermediate transfer belt, and the second transfer is from the intermediate media to print media.

The transfer voltage that is required for efficient transfer of the toner depends on number of factors that vary in the printing process. These factors include environmental temperature and humidity, paper resistivity, transfer roller resistivity, photoconductive drum thickness, etc. If the transfer voltage is either too high or too low, this leads to poor transfer of the toner from the photoconductive drum to the print media. In order to determine a proper setting for the transfer voltage, a sequence of measurements of voltages is done at the beginning of a print job. This sequence of measurements of the voltages is called a transfer servo process.

The transfer servo process comprises a number of sequential steps. Through these sequential steps, a range of voltages are applied to a transfer nip being formed between the photoconductive drum and a transfer roller that is positioned opposite to the photoconductive drum. Thereafter, a current resulting from the application of the voltages is tested to see if the resulting current is greater than or less than a target current level. The target current level is typically eight micro amps. A primary object of applying a range of voltages is to find a servo voltage that produces a current that most nearly matches the target current level. Once the servo voltage is found, it is further used to determine the transfer voltage.

Since a broad range of voltages needs to be investigated, therefore, a coarse search is first done to determine an approximate servo voltage followed by a fine search to refine the determination of the servo voltage. The coarse search starts with a low voltage and voltage is then increased in large voltage steps until the target current level is exceeded. Then, the fine search is performed that starts at a voltage that is below the last coarse voltage and the voltage is increased in small voltage steps until the target current level is exceeded. The coarse search typically includes up to 40 voltage steps and the fine search typically includes up to ten voltage steps, where each step takes about 25 milliseconds. The time to do the resulting search, i.e., coarse search and the fine search is variable and can take up to 1.25 seconds. For a printer running at 50 pages per minute, the coarse search and the fine search would take place over about 4 photoconductive drum revolutions. Therefore, it is desirable to reduce the number of photoconductive drum revolutions that take place outside of actual printing of a page. Reducing photoconductive drum revolutions outside of actual printing, results in longer life of the cartridges and the machines, along with a better print quality.

Additionally, the calculation of transfer voltage includes only one input, the servo voltage. The servo voltage responds proportionally to the resistance of the transfer nip. While the servo voltage serves as a leading indicator for optimum transfer voltage for the efficient transfer of the toner, there are a number of other indicators previously mentioned that affect the optimum transfer voltage. It is desirable to include such factors in the calculation of the transfer voltage. This would result in a more efficient estimate of the optimum transfer voltage given the availability of more information about the system.

Thus, there is a need to provide an apparatus and an algorithm for performing the transfer servo process, i.e., a process for the determination of the transfer voltage that will take less time and provide a more accurate determination of the transfer voltage that is needed for the efficient toner transfer at either the first or the second transfer. Additionally, there is a need to reduce the number of drum revolutions during this process.

SUMMARY OF THE INVENTION

Exemplary embodiments address the shortcomings described above and thereby satisfy a significant need for performing transfer servo operations in an electrophotographic imaging device. In accordance with an exemplary embodiment, there is disclosed a member bearing a toner image; a transfer roller positioned adjacent to the member forming a transfer nip therewith; a voltage generator disposed proximally to the transfer roller for applying a voltage thereto; and a controller communicatively coupled to the member, the transfer roller, and the voltage generator, for transferring the toner image from the member to a recording medium. The controller executes instructions for detecting a condition within the imaging device; determining a servo voltage based on the detected condition; controlling the voltage generator to apply the servo voltage to the transfer roller and measuring a servo current; determining a transfer voltage based on the servo current measured; applying the transfer voltage to the transfer roller during an image transfer operation; measuring transfer current in the transfer nip during one or more inter-page gaps of the image transfer operation; and adjusting the transfer voltage based upon the measured transfer current to create an adjusted transfer voltage. By determining and adjusting the transfer voltage in this way, a substantial amount of time is saved.

In addition, the member may be a photoconductive drum and the voltage generator applies a charge to the photoconductive drum surface corresponding to a printing voltage when the servo voltage is applied to the transfer roller. Further, the controller may determine the transfer voltage based upon a previously measured transfer current. Still further, instead of regularly performing a servo transfer operation, the controller may decide whether a new servo transfer operation is to be performed in part by comparing the determined servo voltage with a previously determined servo voltage. In making such a decision, the controller may decide whether a new servo voltage is to be determined in part based upon at least one of an occurrence of a power-on-reset operation by the imaging apparatus, a cover of the imaging device being opened and the imaging device substantially continuously printing or not printing for at least a predetermined period of time.

Additional features and advantages of the invention will be set forth in the detailed description that follows, and in part will be readily apparent to those skilled in the art from that description or recognized by practicing the invention as described herein, including the detailed description that follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention and the manner of attaining them will become more apparent and will be better understood by reference to the accompanying drawings, wherein.

DETAILED DESCRIPTION

Figure 1:
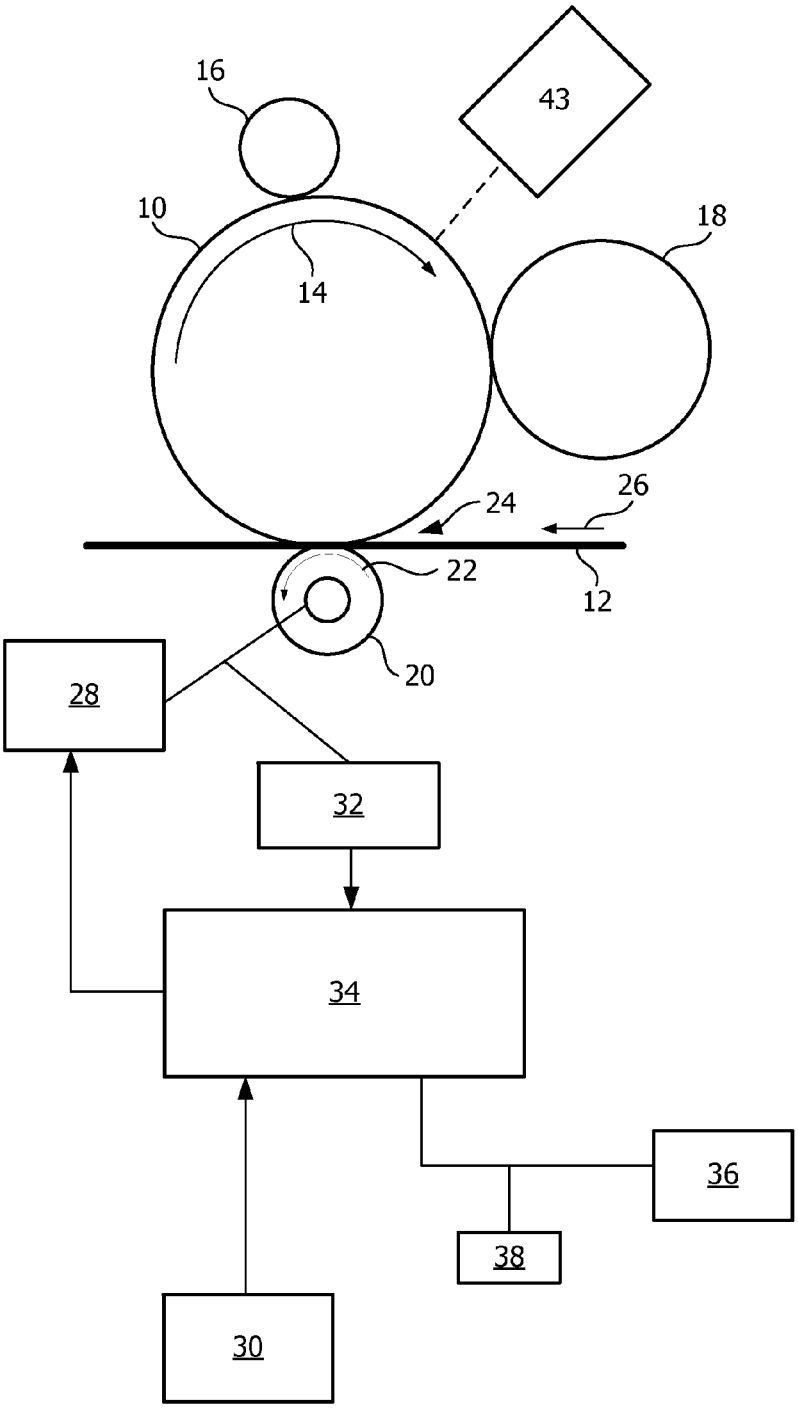
FIG. 1 illustrates general elements of an imaging apparatus involved in transferring a toner image from a photoconductive drum to a recording medium utilizing features or operations in accordance with an exemplary embodiment of the present invention.

Reference will now be made in detail to the exemplary embodiment(s) of the invention as illustrated in the accompanying drawings. Whenever possible, the same reference numerals will be used throughout the drawings to refer to the same or like parts.

FIG. 1 illustrates general elements of an imaging apparatus for transferring a toner image from a photoconductive drum 10 to a recording medium 12 by utilizing aspects of an exemplary embodiment of the present invention. The photoconductive drum 10 rotates in a direction 14 (i.e., clockwise, but could also operate in the other direction if the imaging apparatus were so designed). Also shown are a charge member 16, a developer roll 18, and a transfer roller 20. The charge member 16, the developer roll 18, and the transfer roller 20 are arranged along the direction 14 of rotation of the photoconductive drum 10. The transfer roller 20 rotates in a direction 22 that is opposite to the direction 14 of rotation of the photoconductive drum (i.e., counter clockwise as illustrated).

During an image transfer operation, the photoconductive drum 10 is charged to a voltage by charge member 16. A laser scan unit or the like 43 directs light incident to the surface of the photoconductive drum 10 which creates an electrostatic latent image thereon. Toner from developer roll 18 is applied by electrostatic attraction to the area of the photoconductive drum 10 developing the latent image. The transfer roller 20 being positioned adjacent to the photoconductive drum 10 forms a transfer nip 24 therewith. The recording medium 12, whether an intermediate transfer member or a sheet of media or a sheet of media disposed on a transport belt, travels in a direction 26. A voltage is applied to transfer roller 20 by a voltage generator 28. The applied voltage is such that when the medium 12 passes through the transfer nip 24, the toner image from the photoconductive drum 10 is transferred to the medium 12. A transfer servo method is used to determine the transfer voltage to be applied to the transfer roller 20 for this toner transfer process.

A temperature and relative humidity (T&RH) sensor 30 is provided to read the environmental condition, i.e., temperature and relative humidity (T&RH) under which the imaging apparatus is operating. An analog-to-digital converter 32 is provided to measure the transfer current at the transfer nip 24. Both the T&RH sensor 30 and the analog-to-digital converter 32 are in communication with a controller 34. The controller 34 generally controls the operation of the imaging apparatus. Further, the imaging apparatus may include memory, such as a volatile memory 36 and nonvolatile memory 38. Nonvolatile memory 38 may include program instructions for execution by the controller 34. The controller 34 is also in communication with the voltage generator 28 for controlling same. The voltage generator 28 applies the transfer voltage to the transfer roller 20 corresponding to control input from the controller 34.

Figure 2:
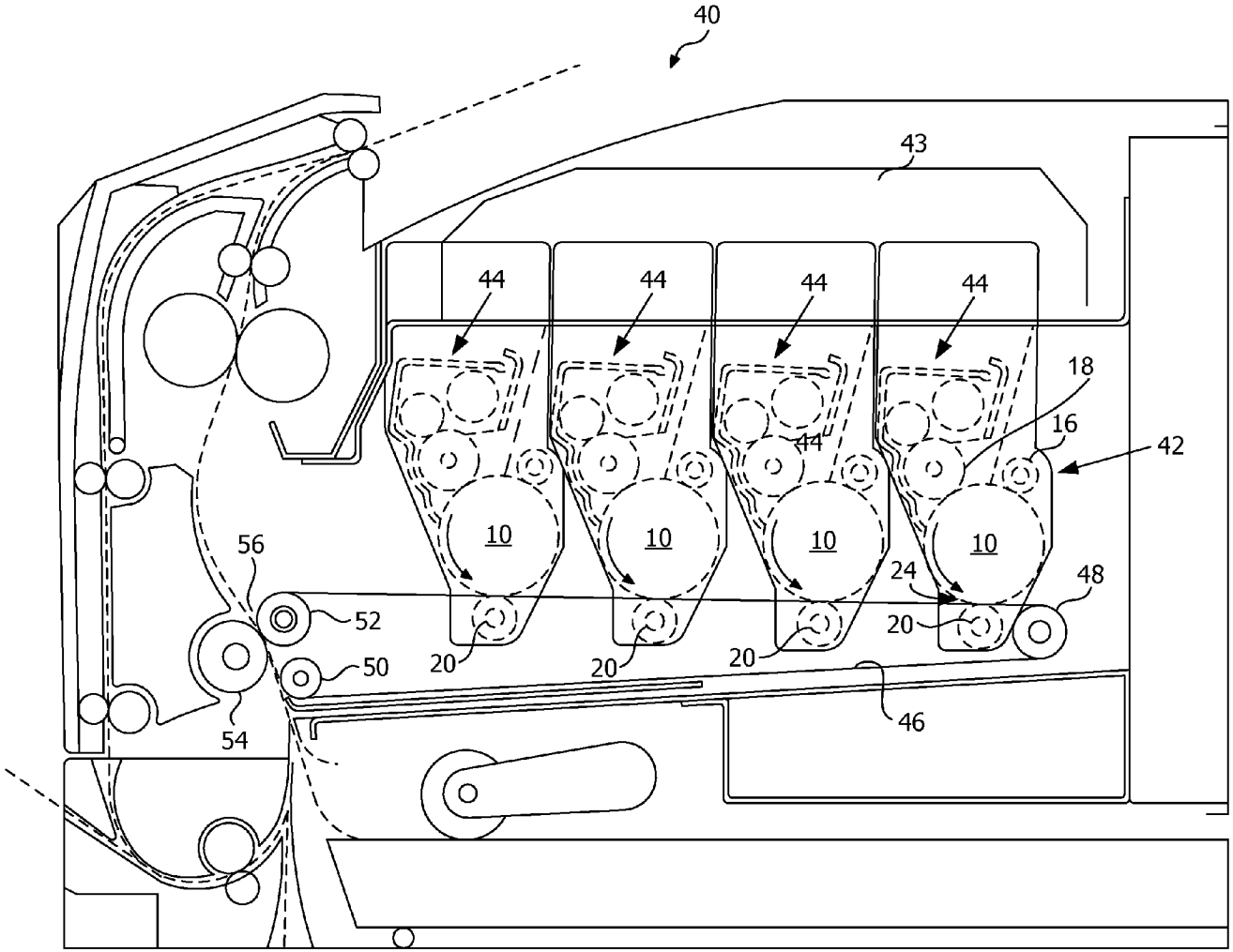
FIG. 2 is a side elevational view of an imaging apparatus having a two step image transfer and incorporating operations in accordance with an exemplary embodiment of the present invention.

FIG. 2 illustrates an imaging apparatus 40 that shows a two-step transfer of the toner image from the photoconductive drum 10 to a sheet of media utilizing aspects of an exemplary embodiment of the present invention. Imaging apparatus 40 includes four independent imaging units 44 for printing with cyan, magenta, yellow, and black toner to produce a color image. Each imaging unit 44 includes the charge member 16, the developer roll 18, and the photoconductive drum 10. The charge member 16 charges the surface of the photoconductive drum 10 to a specified voltage, such as −1000 volts. A laser beam from a laser scan unit 43 contacts the surface of each photoconductive drum 10 and discharges those areas it contacts to form a latent image. The developer roll 18 serves to develop toner into the latent image on the photoconductor (10). The toner particles are attracted to the areas of the photoconductive drum 10 surface discharged by the laser beam from the laser scan unit 43. Each of the four photoconductive drums 10 is positioned opposite a corresponding independent transfer roller 20 such that four independent first transfer nips 24 are formed therewith.

It is understood that each imaging unit 44 operates substantially independently from the other imaging units 44. Accordingly, each imaging unit 44 uses its own independently determined transfer servo voltage and transfer voltage for use in effectuating transfer of toner by the imaging unit 44. It is understood, then, that any discussion herein of independently determining, applying and/or adjusting a transfer voltage for transferring a toner image by one imaging unit 44 may also equally apply to the other imaging units 44.

An intermediate transfer member 46 is disposed adjacent to each of the imaging units 44. In this embodiment, the intermediate transfer member 46 is formed as an endless belt disposed about support roller 48, tension roller 50 and back-up roller 52. During image forming operations, the intermediate transfer member 46 moves relative to the imaging units 44. Each of one or more of the photoconductive drums 10 applies toner images in its respective color to the intermediate transfer member 46 as the intermediate transfer member 46 is passed through the corresponding transfer nip 24. This transfer of the toner images from the photoconductive drums 10 to the intermediate transfer member 46 is known as a first transfer and takes place at a first transfer voltage. As mentioned above, the transfer voltage used by each imaging unit 44 during the first transfer is independently determined.

The toner images collected by the intermediate transfer member 46 are then transferred to a media sheet at a second transfer station. The second transfer station includes back-up roller 52 and a second transfer roller 54 to form a second transfer nip 56 therewith. The transfer of the toner images from the intermediate transfer member 46 to the media sheet is known as the second transfer and takes place at a second transfer voltage that is applied between the second transfer roller 54 and the transfer backup roller (52).

Figure 3:
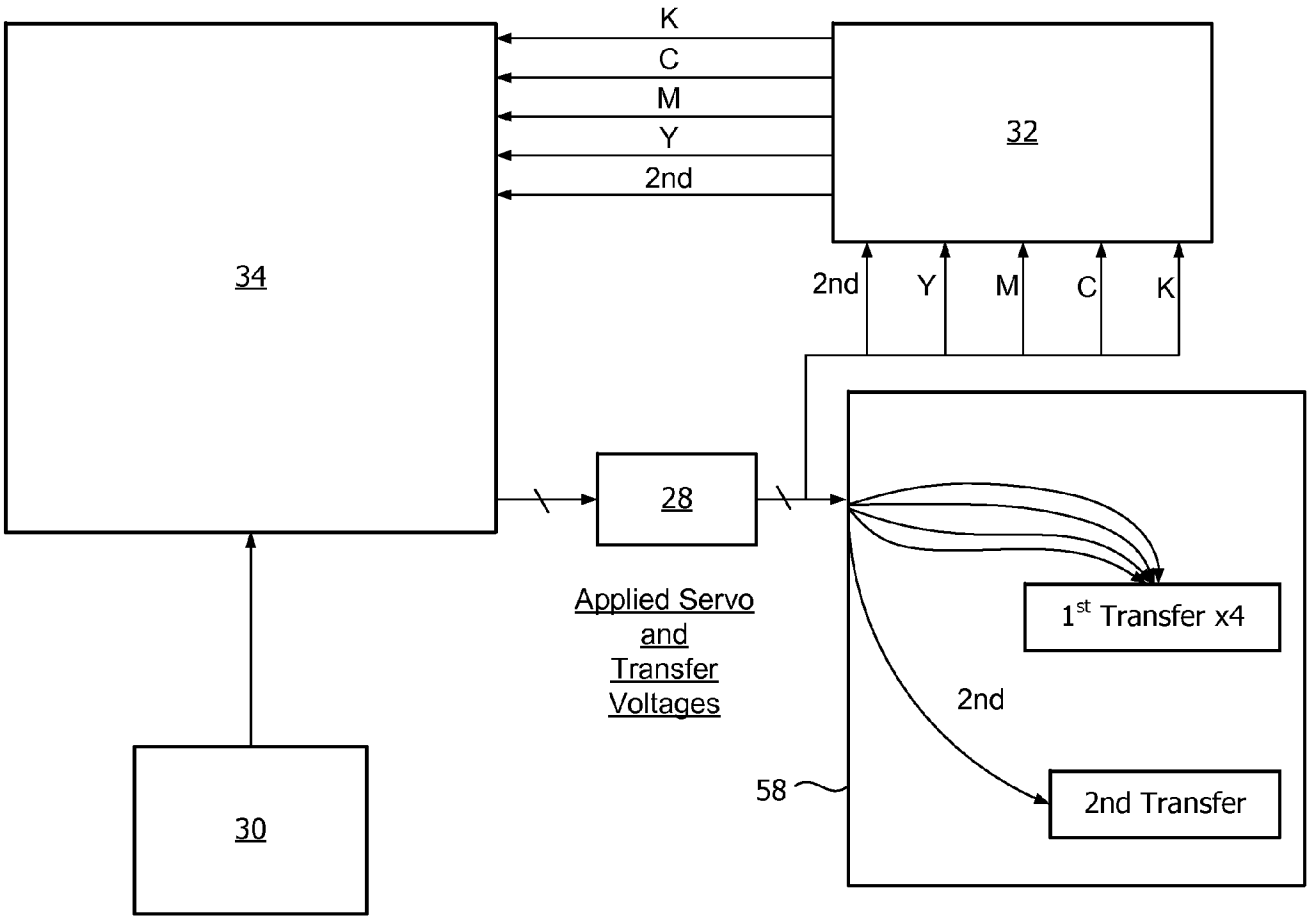
FIG. 3 is a block diagram of a control system used in the imaging apparatus of FIG. 2.

FIG. 3 is a block diagram of electrical control for transfer of the toner image from the photoconductive drums 10 to the sheet of media described in FIG. 2. Shown in FIG. 3 are the controller 34, T&RH sensor 30, analog-to-digital converter 32 (which may be implemented as more than one analog-to-digital converter for performing multiple conversions in parallel), and a transfer module 58. Controller 34 generally controls the overall operation of the imaging apparatus. The controller 34 executes program instructions for executing a first transfer servo algorithm and a second transfer servo algorithm to determine the first transfer voltage and the second transfer voltage, respectively. The controller 34 receives the environmental conditions as detected by the T&RH sensor 30. The transfer module 58 includes the image forming units 44 for effectuating the first transfer and rollers 52 and 54 for effectuating the second transfer. The analog-to-digital converter 32 digitizes current samples received from transfer nips 24 and 56. The digitized current samples are then sent to the controller 34. The controller 34 controls the voltage generator 28 to apply servo voltages and transfer voltages to the transfer module 58.

According to exemplary embodiments of the present invention, an improved transfer servo method is used for determining the transfer voltages at which the toner image is to be transferred during a print operation. This transfer servo method may be used in transferring a toner image in a one step transfer system in which a toner image is transferred from a photoconductive drum 10 directly to a sheet of media, or in a two step transfer system as in FIG. 2 in which a toner image is transferred from a photoconductive drum 10 to the intermediate transfer member 46 in a first transfer and from the intermediate transfer member 46 to a sheet of media in a second transfer. With respect to a two step transfer system, a determination of a transfer voltage may be performed using this method for each of the two transfer steps.

The T&RH sensor 30 reads temperature and/or relative humidity under which the imaging apparatus is operating. Environmental conditions change the conductivity of the transfer rollers, the intermediate transfer member 46 and media sheets and thus may have a significant effect on the selection of the transfer voltage to be used in a print operation. Given the T&RH sensor readings and other information that is available about the next print job, such as print speed and/or media (paper) type, the controller 34 independently determines for each imaging unit 44 and second transfer nip 56 a servo voltage to be applied to produce a servo current.

The servo voltage calculation for the first image transfer (i.e., from any photoconductive drum 10) may be based upon the operating temperature, relative humidity, print speed, the charge voltage and thickness of the photoconductive drum 10, media type (for a single step transfer system) and/or whether the print operation is simplex or duplex (for a single step transfer system). The servo voltage calculation for the second image transfer in a two step transfer system of FIG. 2 (from the intermediate transfer member 46 to a sheet of media) may be based upon factors such as temperature, relative humidity, print speed, media type and whether the print operation is simplex or duplex mode.

After the servo voltage is determined, the controller 34 applies the determined servo voltage to the particular transfer roller to obtain a servo current. The analog-to-digital converter 32 measures the servo current. Then, on the basis of the servo current measured, a resistance of the corresponding transfer nip is determined. Finally, the controller 34 determines the transfer voltage based on the resistance of the corresponding transfer nip and/or other parameters like temperature, relative humidity, servo voltage, and a previously measured transfer current. The transfer voltage for a first transfer (i.e., from any photoconductive drum 10 to an intermediate transfer member 46 or a sheet of media) thus may be based upon the operating temperature, relative humidity, print speed, the charge voltage and/or thickness of the photoconductive drum 10, the servo voltage, media type (in the case of a single transfer to a sheet of media) whether the operation is for a simplex or duplex printing (also for the case of single transfer to a sheet of media), and/or the measured servo current. The transfer voltage for a second transfer (from the intermediate transfer member 46 to a sheet of media) may be based upon similar factors, such as operating temperature, relative humidity, print speed, the servo voltage, media type, whether the operation is for a simplex or duplex operation and/or the measured servo current.

With the transfer voltage determined, the controller 34 controls the voltage generator 28 to apply the determined transfer voltage to the corresponding transfer roller (20 or 54). This application of the transfer voltage to the transfer roller facilitates the toner transfer from a photoconductive drum 10 (in the case of a single transfer system or a first transfer of a two-step transfer system) or the intermediate transfer member 46 (in the case of the second transfer of the two-step transfer system).

The charge voltage of the surface of the photoconductive drum 10 influences current measured during the transfer servo process. Presently, the photoconductive charge voltage is set to a fixed value, typically about −400 v, so that the current measurement could be performed against a known charge voltage. Since the charge roller 16 is located on the other side of the photoconductive drum 10, switching the charge voltage to this fixed level results in an additional revolution of the photoconductive drum 10 in the transfer servo process. It takes about one half of a revolution to bring the −400 v charged area of the photoconductive drum 10 around to the transfer nip 24 and another one half revolution to subsequently charge the photoconductive drum 10 to a print voltage. In the improved transfer servo method according to exemplary embodiments of the present invention, the servo current measurement is performed with the charge voltage of the photoconductive drum 10 set to its print voltage to save this extra revolution. This can be compensated for in the empirical equation used for determining the transfer voltage since the measured servo current is proportional to the difference between the servo voltage and the charge voltage of the photoconductive drum 10, both of which are known.

Once the transfer servo process has finished and the transfer voltage is set, there is less need for another servo measurement for print jobs that follow soon after the current print job because environmental conditions generally do not change rapidly. A new transfer servo process may be performed when a new print job is submitted and the determined servo voltage differs relatively significantly from the previously determined servo voltage, such as due to a significant change in an environmental condition or a significant lapse in time since the previous print job. The new transfer servo process may also be performed if the cover of the imaging apparatus had been opened or upon the occurrence of a power-on-reset (POR) condition. An algorithm may be used to decide whether a new transfer servo operation, and thus a new transfer voltage, is necessary. Whether to perform a new transfer servo process thus may be based upon the elapsed period of time since the last transfer servo operation, a change in the determined servo voltage exceeding a predetermined threshold amount, the occurrence of a POR event, and/or the cover of the imaging apparatus being opened.

When a large number of pages are printed, the operating temperature of an imaging apparatus tends to increase and cause a drift in the transfer voltage needed for an acceptable transfer of the toner image. Presently, a new transfer servo process may be performed if the imaging apparatus is operating for longer than about ten minutes without performing a transfer servo process. An improved transfer servo method, in accordance with exemplary embodiments of the present invention, includes measuring a plurality of currents during inter-page gaps between successive media sheets using the analog-to-digital converter 32. Because no toner is transferred during an inter-page gap, toner-related current will not influence the measurement of the transfer current. Measurements from the last n pages, where n is a predetermined number, are then used to calculate an adjustment to the transfer voltage. The adjustment of the transfer voltage for first transfer (from photoconductive drum 10 to intermediate transfer member 46 or directly to a sheet of media) thus may be based upon the operating temperature, relative humidity, print speed, the charge voltage and thickness of the photoconductive drum 10, the simplex/duplex print mode (for a single transfer system) and/or the inter-page gap transfer currents corresponding to the last n pages. The adjustment of the transfer voltage for a second transfer (from the intermediate transfer member 46 to a sheet of media) may be based upon the operating temperature, relative humidity, print speed, the simplex/duplex print mode, and/or the inter-page gap transfer currents corresponding to the last n pages.

In a transfer nip where toner is being transferred to a sheet of media, such as paper, a significant resistance to the flow of current may occur. If the current is not controlled during an inter-page gap, a high current can be possibly injected into the photoconductive drum 10 (for a one step transfer system) or the intermediate transfer member 46 (for a two step transfer system). This higher current can result in a "ghost" being produced on the photoconductive drum 10 or intermediate transfer member 46. The inter-page gap transfer voltage is typically selected to have a single value for all conditions. Ideally the inter-page gap voltage would produce substantially the same current flow as the current produced for the preceding page. However, this is difficult with use of a single value for the inter-page gap transfer voltage. In accordance with an exemplary embodiment of the present invention, current measurement using the analog-to-digital converter 32 could be used in conjunction with closed loop control to monitor the current flow during printing of the preceding page, and then controller 34 may dynamically adjust the inter-page gap voltage to provide substantially the same current. Such inter-page gap voltage control has been seen to substantially reduce or otherwise eliminate the ghost produced on the photoconductive drum 10 or intermediate transfer member 46 during the inter-page gap.

Figure 4:
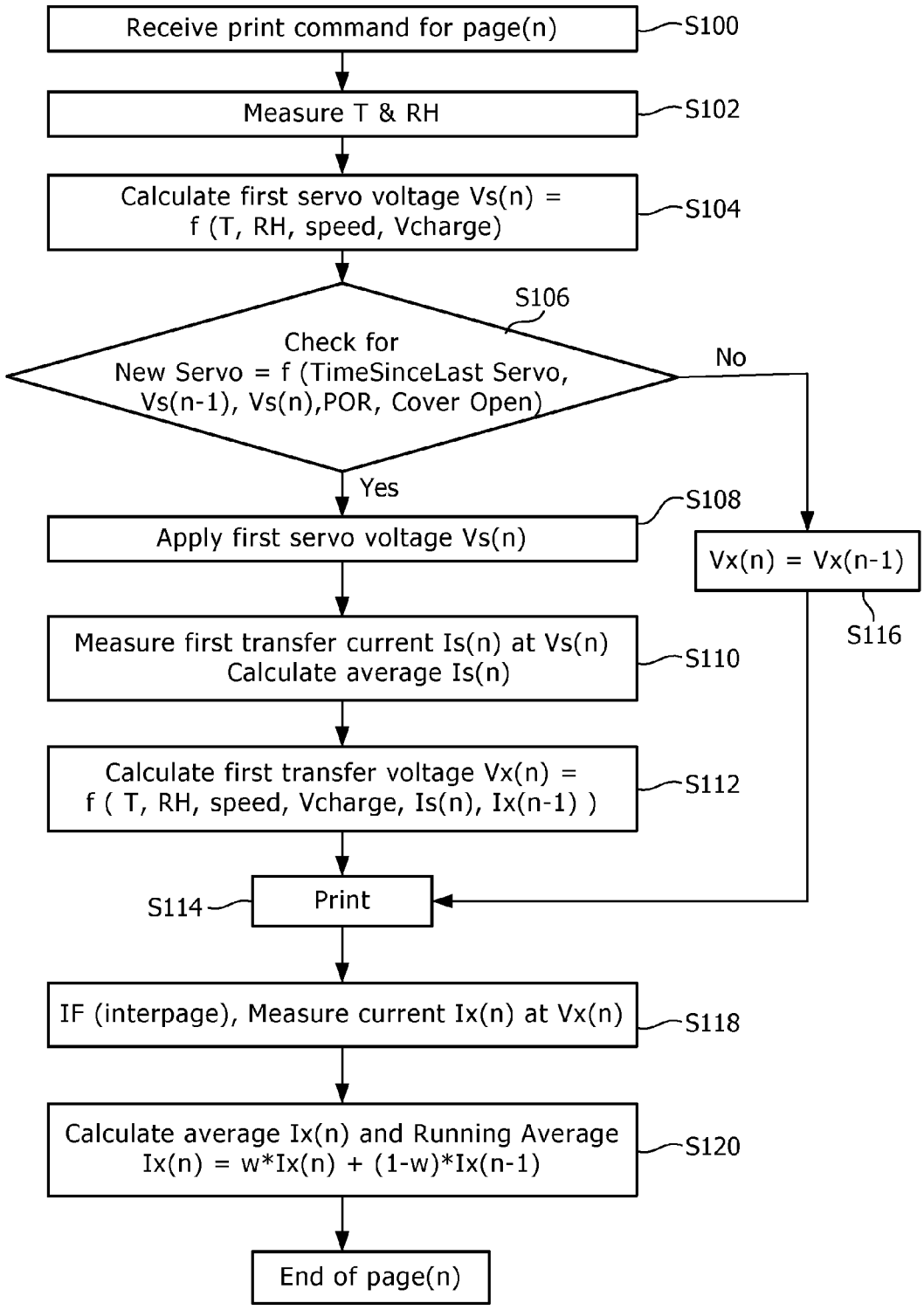
FIG. 4 is a flowchart demonstrating the execution of a first transfer servo algorithm according to an exemplary embodiment of the present invention.

FIG. 4 is a flowchart illustrating execution of a first transfer servo algorithm to independently determine and apply a first transfer voltage to each individual transfer nip 24 at which a toner image is transferred from the corresponding photoconductive drum 10 to a sheet of media (for a one step transfer system) or the intermediate transfer member 46 (for a two step transfer system) according to an exemplary embodiment of the present invention. The first transfer servo algorithm is described below relative to a single imaging unit 44 but it is understood that the algorithm may be separately and independently used for each imaging unit 44.

The algorithm is exercised before the printing of every page, but a transfer servo is typically only done at the beginning of a print job. Initially, at block S100 a command is received by the controller 34 for printing page n. At block S102, the T&RH sensor 30 measures temperature and relative humidity. At block S104, with the temperature and humidity readings and other information that is available about the next print job (print speed, media type, etc.), the controller 34 calculates a first servo voltage Vs(n) for the imaging unit 44. The first servo voltage Vs(n) is determined such that it produces in the image forming unit 44 a current flow at the corresponding first transfer nip 24 between the photoconductive drum 10 and the first transfer roller 20. The first servo voltages Vs(n) may be determined based upon temperature, relative humidity, and/or the charge voltage and thickness of the photoconductive drums 10. At block S106, the controller 34 determines whether a new transfer servo operation is desired. As explained above, whether to perform a new transfer servo operation may be based on the time elapsed since last servo voltage measurement for the imaging unit 44, the difference between a most recently calculated first servo voltage Vs(n) and a previously determined servo voltage Vs(n−1) for the imaging unit 44, the existence of a POR event, and/or the cover of the image forming apparatus being opened. If the controller 34 determines that a new transfer servo operation is desired, at block S108 the controller 34 controls the voltage generator 28 to apply the first servo voltage Vs(n) to the transfer roller 20 of the imaging unit 44. At block S110, a servo current Is(n) resulting from the application of the first servo voltage Vs(n) to the first transfer roller 20 of the imaging unit 44 is measured by the analog-to-digital converter 32. At block S112, the controller 34 calculates the first transfer voltage Vx(n) for the imaging unit 44 based on the temperature and relative humidity, print speed, the charge voltage of the photoconductive drum 10, the servo current Is(n) and/or average thereof, and/or the previously measured transfer current Ix(n−1).

At block S114, the controller 34 controls the voltage generator 28 to apply the first transfer voltage Vx(n) to the transfer roller 20 of the imaging unit 44 in order to transfer the toner image from the corresponding photoconductive drum 10. The application of the first transfer voltage Vx(n) may result in the transfer of the toner image from photoconductive drum 10 to the intermediate transfer member 46 or sheet of media (for a one step transfer system).

Alternatively, if the controller 34 decides a new transfer servo operation is not required, at block S116 the controller 34 uses the previously determined first transfer voltage Vx(n−1) as the first transfer voltage Vx(n) for the imaging unit 44.

At block S118, during the inter page gap the transfer current Ix(n) at the transfer nip 24 of the imaging unit 44 is measured. The transfer current Ix(n) is measured during an inter-page gap so there is substantially no toner-related current to influence the current measurement. A plurality of transfer currents Ix(n) are obtained at the first transfer voltage Vx(n) at transfer nip 24 of imaging unit 44. At block S120, the currents are averaged to obtain average transfer current Ix(n) for the imaging unit 44. Further, a running average current Ix(n) is calculated by using following equation.

$$\text{Running average } Ix(n)=w*Ix(n)+(1-w)*Ix(n-1),$$

where w is a weight assigned to current Ix(n). The weight w may be encoded in the software executed by controller 34 and determined by experimental testing. The average transfer current Ix(n) and/or running average transfer current Ix(n) for the last m pages may be used to make an adjustment to the first transfer voltage Vx(n) of the imaging unit 44.

Figure 5:
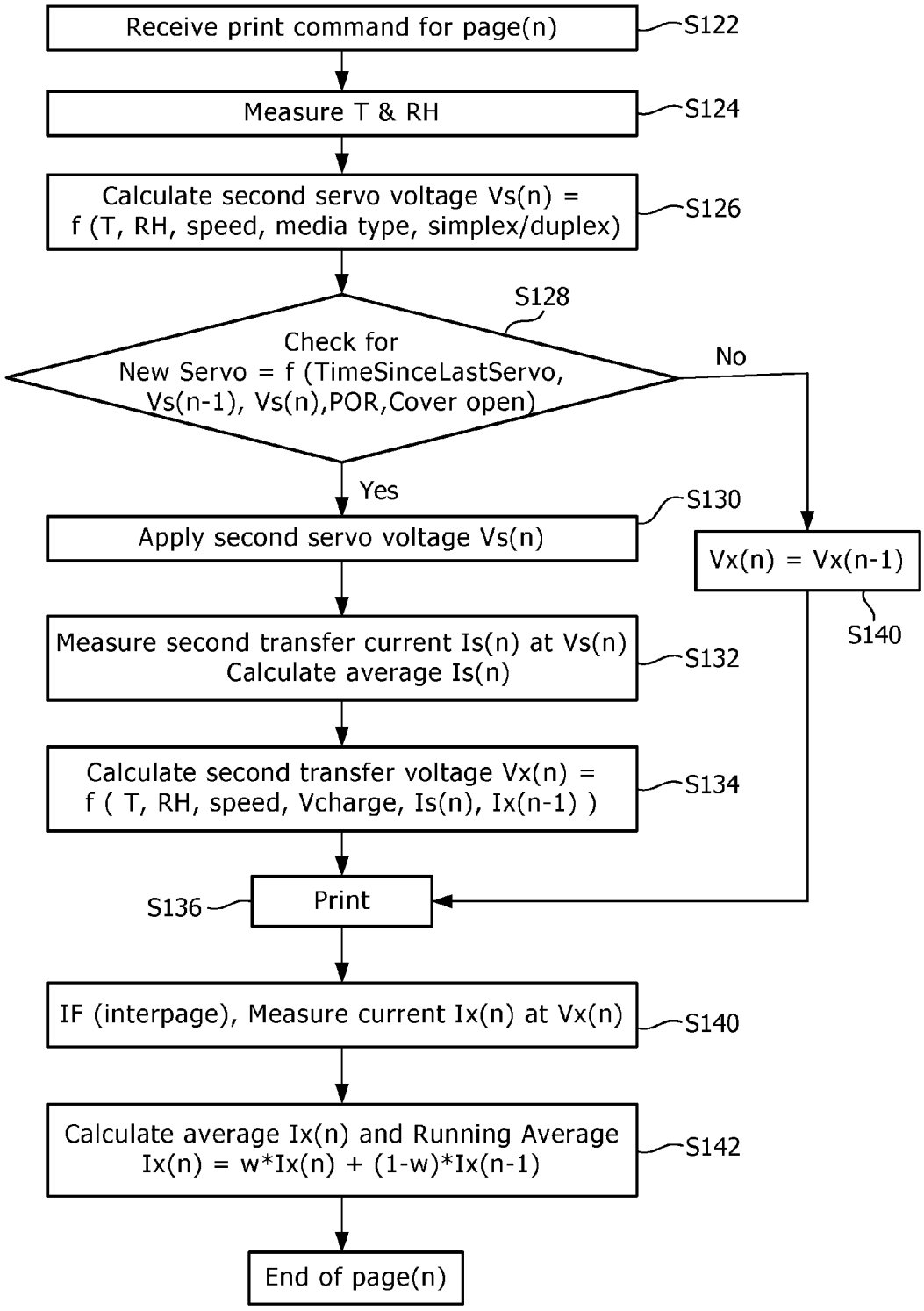
FIG. 5 is a flowchart demonstrating the execution of a second transfer servo algorithm according to an embodiment of the present invention.

FIG. 5 is a flowchart illustrating execution of a second transfer servo algorithm to determine and apply a second transfer voltage at which the toner image previously transferred to the intermediate transfer member 46 is transferred to a sheet of media according to an exemplary embodiment of the present invention. At block S122, a print command is received by the controller 34. At block S124, T&RH sensor 30 measures the temperature and relative humidity. At block S126, with the temperature and relative humidity readings and other information that is available about the next print job (print speed, media type, whether the media path is simplex/duplex, etc.), the controller 34 calculates a second servo voltage Vs(n) for the transfer roller 54. The second servo voltage Vs(n) is determined such that a current flows between the back-up roller 52 and the transfer roller 54 in an absence of any media sheet in the transfer nip 56. The second servo voltage Vs(n) thus may be determined based upon temperature, relative humidity, print speed.

At block S128, the controller 34 decides whether a new second transfer voltage Vx(n) is desired. This decision is based on the time elapsed since last transfer servo operation, the difference between the currently calculated second servo voltage Vs(n) and the previously determined second servo voltage Vs(n−1), whether the cover of the imaging apparatus was opened, and/or whether a POR event occurred. If the controller 34 decides a new transfer servo operation is desired, at block S130 the controller 34 applies the second servo voltage Vs(n) calculated in block S126 to the transfer roller 54. At block S132, a second servo current Is(n) resulting from application of the second servo voltage to the transfer roller 54 is measured. At block S134, the controller 34 calculates the second transfer voltage Vx(n) based on the temperature and relative humidity, media type, whether the media path is simplex or duplex mode, the second servo current Is(n) and/or the average thereof, and/or a previously measured second transfer current Ix(n−1).

At block S136, the controller 34 applies the determined second transfer voltage Vx(n) to the transfer roller 54 to effectuate transfer of the toner image. The application of the second transfer voltage Vx(n) results in the transfer of the toner image from the intermediate transfer member 46 to the sheet of media. Alternatively, if the controller 34 decides that a new transfer servo operation is not required, at block S138 the controller 34 applies the previously determined second transfer voltage Vx(n−1) as the current second transfer voltage Vx(n).

At block S140, transfer current Ix(n) is measured at the second nip 56. This current Ix(n) is measured during one or more inter-page gaps so there is substantially no toner-related current to influence the measurement of the transfer current Ix(n). A plurality of transfer currents Ix(n) may be obtained. At block S142, the measured transfer currents are averaged to obtain an average transfer current Ix(n). Further, a running average transfer current Ix(n) may be calculated using the running average equation above. The average transfer current Ix(n) and the running average transfer current Ix(n) for the last m pages may be used to make an adjustment to the second transfer voltage Vx(n) for a subsequent transfer operation.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method for determining and applying a transfer voltage for use in an imaging apparatus having a member bearing a toner image, a transfer roller positioned adjacent to the member forming a transfer nip therewith, the method comprising:

detecting a condition associated with an imaging apparatus;

determining a servo voltage to be applied to the transfer roller during a transfer servo operation, the determining being based on the condition detected, the servo voltage being determined prior to a voltage being applied to the transfer roller during the transfer servo operation;

applying the servo voltage to the transfer roller and measuring a servo current in the transfer nip;

determining a transfer voltage based on the servo current;

applying the transfer voltage to the transfer roller during an image transfer operation by the imaging apparatus;

measuring transfer current in the transfer nip during one or more inter-page gaps of the image transfer operation; and adjusting the transfer voltage based upon the measured transfer current to create an adjusted transfer voltage.

2. The method of claim 1, wherein the member comprises a photoconductive surface and the applying the servo voltage and the measuring the servo current are done with the photoconductor surface charged to a printing voltage.

3. The method of claim 1, wherein the transfer voltage is determined based upon a previously measured transfer current.

4. The method of claim 1, further comprising deciding, following the determining the servo voltage, whether a new transfer voltage is to be determined.

5. The method of claim 4, wherein the deciding comprises comparing the determined servo voltage with a previously determined servo voltage.

6. The method of claim 4, wherein the deciding is based upon at least one of an occurrence of a power-on-reset operation by the imaging apparatus, a cover of the imaging apparatus being opened and the imaging apparatus substantially continuously printing for at least a predetermined period of time.

7. The method of claim 1, further comprising, during an inter-page gap of the image transfer operation, changing the applied transfer voltage to an inter-page gap voltage to produce a current in the transfer nip during the inter-page gap that is substantially the same as the transfer current when a sheet of paper is in the transfer nip.

8. The method of claim 1, wherein the transfer current measured comprises a plurality of transfer current measurements and the adjusted transfer voltage is based upon an average of the transfer current measurements.

9. The method of claim 1, wherein the transfer current measured comprises a plurality of transfer current measurements and the adjusted transfer voltage is based upon a running average of the transfer current measurements.

10. An imaging device, comprising:

a member bearing a toner image;

a transfer roller positioned adjacent to the member forming a transfer nip therewith;

a voltage generator disposed proximally to the transfer roller for applying a voltage thereto; and a controller communicatively coupled to the member, the transfer roller, and the voltage generator, for transferring the toner image from the member to a recording medium, the controller executing instructions for:

detecting a condition within the imaging device;

determining a servo voltage based on the detected condition;

controlling the voltage generator to apply the servo voltage to the transfer roller and measuring a servo current, the servo voltage being the only voltage applied to the transfer roller during a transfer servo operation;

determining a transfer voltage based on the servo current measured;

applying the transfer voltage to the transfer roller during an image transfer operation;

measuring transfer current in the transfer nip during one or more inter-page gaps of the image transfer operation; and adjusting the transfer voltage based upon the measured transfer current to create an adjusted transfer voltage.

11. The device of claim 10, wherein the member comprises a photoconductive drum and the voltage generator applies a charge to the photoconductive drum surface corresponding to a printing voltage when the servo voltage is applied to the transfer roller.

12. The device of claim 10, wherein the controller determines the transfer voltage based upon a previously measured transfer current.

13. The device of claim 10, wherein the controller decides, following the determining the servo voltage, whether a new servo voltage is to be determined.

14. The device of claim 13, wherein the controller decides whether a new transfer voltage is to be determined in part by comparing the determined servo voltage with a previously determined servo voltage.

15. The device of claim 13, wherein the controller decides whether a new servo voltage is to be determined in part based upon at least one of an occurrence of a power-on-reset operation by the imaging apparatus, a cover of the imaging device being opened and the imaging device substantially continuously printing for at least a predetermined period of time.

16. The device of claim 10, wherein during an inter-page gap, the controller controls the voltage generator to change the applied transfer voltage to a predetermined inter-page gap voltage to produce a current in the transfer nip during the inter-page gap that is substantially the same as the transfer current when a sheet of media is in the transfer nip.

17. The device of claim 10, wherein the transfer current measured comprises a plurality of transfer current measurements and the adjusted transfer voltage is based upon at least one of an average of the transfer current measurements and a running average thereof.

18. An imaging device, comprising:

a member bearing a toner image;

a transfer roller positioned adjacent to the member forming a transfer nip therewith;

a voltage generator disposed proximally to the transfer roller for applying a voltage thereto; and a controller communicatively coupled to the member, the transfer roller and the voltage generator for transferring the toner image from the member to a recording medium, the controller executing instructions for:

determining a servo voltage for performing a transfer servo operation;

determining whether a new transfer servo operation is to be performed, comprising comparing the determined servo voltage with a servo voltage used in the last transfer servo operation;

upon an affirmative determination that a new transfer servo operation is to be performed, controlling the voltage generator to apply the determined servo voltage to the transfer roller and measure a servo current;

determining a transfer voltage based on the servo current measured; and applying the transfer voltage to the transfer roller during an image transfer operation.

19. The imaging device of claim 18, wherein the member comprises a photoconductive drum and the controller controls the voltage generator to apply a charge to the photoconductive drum surface corresponding to a printing voltage prior to the servo voltage being applied to the transfer roller.

20. The imaging device of claim 18, wherein the controller executes instructions for measuring a transfer current during one or more inter-page gaps of the image transfer operation, and adjusting the transfer voltage based upon the measured transfer current.

21. The imaging device of claim 18, wherein the controller determines the servo voltage based upon an environmental condition under which the imaging device is operating.

22. The method of claim 1, wherein determining the servo voltage comprises calculating the servo voltage based upon the detected condition.

23. The method of claim 22, wherein the servo voltage is calculated based upon one or more of print speed, media type and whether the image transfer operation corresponds to a simplex or duplex print operation.

24. The device of claim 10, wherein the instructions for determining the servo voltage comprise instructions for calculating the servo voltage based upon the detected condition.

25. The device of claim 24, wherein the servo voltage is calculated based upon one or more of print speed, media type and whether the image transfer operation corresponds to a simplex or duplex print operation.

26. The method of claim 1, wherein the servo voltage is the only voltage applied to the transfer roller during the transfer servo operation.

27. The device of claim 10, wherein the servo voltage is determined prior to a voltage being applied to the transfer roller during the transfer servo operation.

28. The device of claim 18, wherein the servo voltage is determined prior to a voltage being applied to the transfer roller during the transfer servo operation.

29. The device of claim 18, wherein the servo voltage is the only voltage applied to the transfer roller during the transfer servo operation.

30. A method for determining and applying a transfer voltage for use in an imaging apparatus having a member bearing a toner image, a transfer roller positioned adjacent to the member forming a transfer nip therewith, the method comprising:

detecting a condition associated with an imaging apparatus;

determining a servo voltage based on the condition detected;

applying the servo voltage to the transfer roller and measuring a servo current in the transfer nip;

determining a transfer voltage based on the servo current;

applying the transfer voltage to the transfer roller during an image transfer operation by the imaging apparatus;

measuring transfer current in the transfer nip during one or more inter-page gaps of the image transfer operation; and adjusting the transfer voltage based upon the measured transfer current to create an adjusted transfer voltage, wherein the transfer current measured comprises a plurality of transfer current measurements and the adjusted transfer voltage is based upon an average of the transfer current measurements.

31. The method of claim 30, wherein the average is a running average of the transfer current measurements.

32. An imaging device, comprising:

a member bearing a toner image;

a transfer roller positioned adjacent to the member forming a transfer nip therewith;

a voltage generator disposed proximally to the transfer roller for applying a voltage thereto; and a controller communicatively coupled to the member, the transfer roller, and the voltage generator, for transferring the toner image from the member to a recording medium, the controller executing instructions for:

detecting a condition within the imaging device;

determining a servo voltage based on the detected condition;

controlling the voltage generator to apply the servo voltage to the transfer roller and measuring a servo current;

determining a transfer voltage based on the servo current measured;

applying the transfer voltage to the transfer roller during an image transfer operation;

measuring transfer current in the transfer nip during one or more inter-page gaps of the image transfer operation; and adjusting the transfer voltage based upon the measured transfer current to create an adjusted transfer voltage, wherein the transfer current measured comprises a plurality of transfer current measurements and the adjusted transfer voltage is based upon at least one of an average of the transfer current measurements and a running average thereof.

* * * * *